US007178631B2

(12) United States Patent
Salmi et al.

(10) Patent No.: US 7,178,631 B2
(45) Date of Patent: Feb. 20, 2007

(54) AERIAL LADDER CRADLE ASSEMBLY

(75) Inventors: James A. Salmi, Lititz, PA (US); Reid L. Wissler, Brownstone, PA (US); Jason L. Longenecker, Denver, PA (US)

(73) Assignee: Spartan Motors, Inc., Charlotte, MI (US)

( * ) Notice: Subject to any disclaimer, the term of this patent is extended or adjusted under 35 U.S.C. 154(b) by 297 days.

(21) Appl. No.: 10/828,821

(22) Filed: Apr. 21, 2004

(65) Prior Publication Data

US 2005/0236226 A1 Oct. 27, 2005

(51) Int. Cl.
*E06C 5/00* (2006.01)

(52) U.S. Cl. ..... 182/2.5; 182/65.1

(58) Field of Classification Search ..... 182/2.5, 182/64.1–67.3
See application file for complete search history.

(56) References Cited

U.S. PATENT DOCUMENTS

| | | | | | |
|---|---|---|---|---|---|
| 2,951,549 | A | * | 9/1960 | Holan et al. | 182/66.2 |
| 3,648,782 | A | * | 3/1972 | Mazzarins | 172/821 |
| 3,749,182 | A | * | 7/1973 | Rockwell | 172/821 |
| 3,966,344 | A | * | 6/1976 | Haker et al. | 404/117 |
| 4,054,182 | A | | 10/1977 | Ide | |
| 4,094,381 | A | * | 6/1978 | Wilkerson | 182/66.1 |
| 4,128,139 | A | | 12/1978 | Cook, Sr. | |
| 4,335,803 | A | | 6/1982 | Sugita | |
| 4,512,439 | A | * | 4/1985 | Howell | 182/66.2 |
| 4,923,050 | A | | 5/1990 | Vitols | |
| 5,339,919 | A | | 8/1994 | Boyd | |
| 5,366,052 | A | | 11/1994 | Keh-Lin | |
| 5,626,440 | A | | 5/1997 | Greene, Jr. et al. | |
| 5,924,523 | A | | 7/1999 | Krause | |
| 6,146,078 | A | * | 11/2000 | Hamill et al. | 414/511 |
| 6,629,582 | B2 | | 10/2003 | Barnett | |

FOREIGN PATENT DOCUMENTS

EP 04700912.1-2223 5/2006

* cited by examiner

*Primary Examiner*—Alvin Chin-Shue
(74) *Attorney, Agent, or Firm*—Foster, Swift, Collins & Smith, P.C.; Allan O. Maki

(57) ABSTRACT

A cradle assembly for aerial ladders (or booms) includes an assembly for rotatably and pivotally supporting an aerial ladder or boom, a first pair of upwardly extending parallel support flanges and a second pair of upwardly extending parallel support flanges extending upwardly from the surface of said turntable, the second pair of flanges extending to a substantially lesser elevation than said first pair of flanges; a cradle formed by a pair of parallel cradle arms laterally spaced to support a base end of said ladder or boom therebetween and at least one cross member connecting said arms, each of said arms having an end pivotally connected to a flange of said first pair of flanges; a hydraulic cylinder pivotally (which may be dual acting) attached to each of said cradle arms at a point spaced away from said first pair of flanges and an extendable-retractable rod projecting from each hydraulic cylinder and having an outer end pivotally attached to a flange of said second pair of flanges.

7 Claims, 6 Drawing Sheets

AERIAL LADDER CRADLE ASSEMBLY

BACKGROUND OF THE INVENTION

1. Field of the Invention

The present invention generally relates to aerial ladders and particularly to an aerial ladder cradle assembly with an attachment means to allow the ladder to be deployed at a negative horizontal angle, improve operator visibility, improve compartment space, and improve leverage angle efficiency.

2. Discussion of Related Art

A common problem in aerial ladders for fire trucks is the inherent inability to deploy at a negative horizontal angle. Further, many aerial ladders have poor operator visibility and low leverage angle efficiency. There is known in the art ladders that tilt down from a horizontal position. However, none are known that use an elevated cradle. U.S Pat. No. 5,366,052 to Keh-Lin discloses a device that may be used as a conveyor in an upright position and as a ladder when lowered to the ground from that horizontal position. U.S Pat. No. 5,626,440 to Greene, Jr., et al discloses a retractable stairway that in a horizontal position that can be tilted to an extended position 45 degrees from the horizontal position. U.S. Pat. No. 4,335,803 to Sugita discloses a gangway ladder having its one end supported by a truck assembly so as to be tiltable to a horizontal or a downward position. U.S. Pat. No. 5,339,919 to Boyd discloses a boarding ladder assembly that moves the ladder from a vertical stored position to a downward position while in use.

Despite attempts in the prior art to improve range of motion of mounted ladders, none have been able to employ a cradle mount. Thus, there is a desire and a need in the art not only to increase the range of motion of a mounted aerial ladder for rescue situations, but also to improve operator visibility and improve leverage angle efficiency.

SUMMARY OF THE INVENTION

Accordingly, the present invention provides a cradle mount for aerial ladders (or booms).

In one embodiment of the present invention, an assembly for rotatably and pivotally supporting an aerial ladder or boom has a turntable adapted to be mounted on a vehicle for rotation about a vertical axis, a first pair of upwardly extending parallel support flanges and a second pair of upwardly extending parallel support flanges extending upwardly from the surface of said turntable, the second pair of flanges extending to a substantially lesser elevation than said first pair of flanges; a cradle formed by a pair of parallel cradle arms laterally spaced to support a base end of said ladder or boom therebetween and at least one cross member connecting said arms, each of said arms having an end pivotally connected to a flange of said first pair of flanges; a hydraulic cylinder pivotally (which may be dual acting) attached to each of said cradle arms at a point spaced away from said first pair of flanges and an extendable-retractable rod projecting from each hydraulic cylinder and having an outer end pivotally attached to a flange of said second pair of flanges.

The cylinders may be connected to the arms by means of aligned trunnion pins projecting outwardly from opposite sides of the cylinders. Also, the hydraulic cylinder rods do not need to be fully retracted into the cylinders when said ladder or boom is in the horizontal position, whereby an outer end of said ladder or boom can be lowered below the horizontal position.

The trunnion pins may attached to the exterior of a hoop which encircles and is attached, such as by weld to the body of said hydraulic cylinder. The trunnion pins may be positioned in the middle or adjacent the end of said cylinder through which said rod extends.

The cradle arms are bifurcated at the point at which said trunnion pins are attached, said cylinders being fitted between said bifurcations, each of which have an aperture through which one of said trunnion pins extends.

Other features of the present invention will become more apparent to persons having ordinary skill in the art to which the present invention pertains from the following description and claims taken in conjunction with the accompanying figures.

BRIEF DESCRIPTION OF THE FIGURES

The foregoing features, as well as other features, will become apparent with reference to the description and figures below, in which like numerals represent like elements, and in which.

DETAILED DESCRIPTION OF THE INVENTION

The present invention generally relates to aerial ladders and particularly to an aerial ladder cradle assembly with an attachment means to allow the ladder to be deployed at a negative horizontal angle, improve operator visibility, improve rescue capability, and improve leverage angle efficiency. Specifically, the resulting aerial ladder configuration of the present invention allows an improved functional range of motional including a tilt down 10 degrees from a horizontal position.

Figure 5:
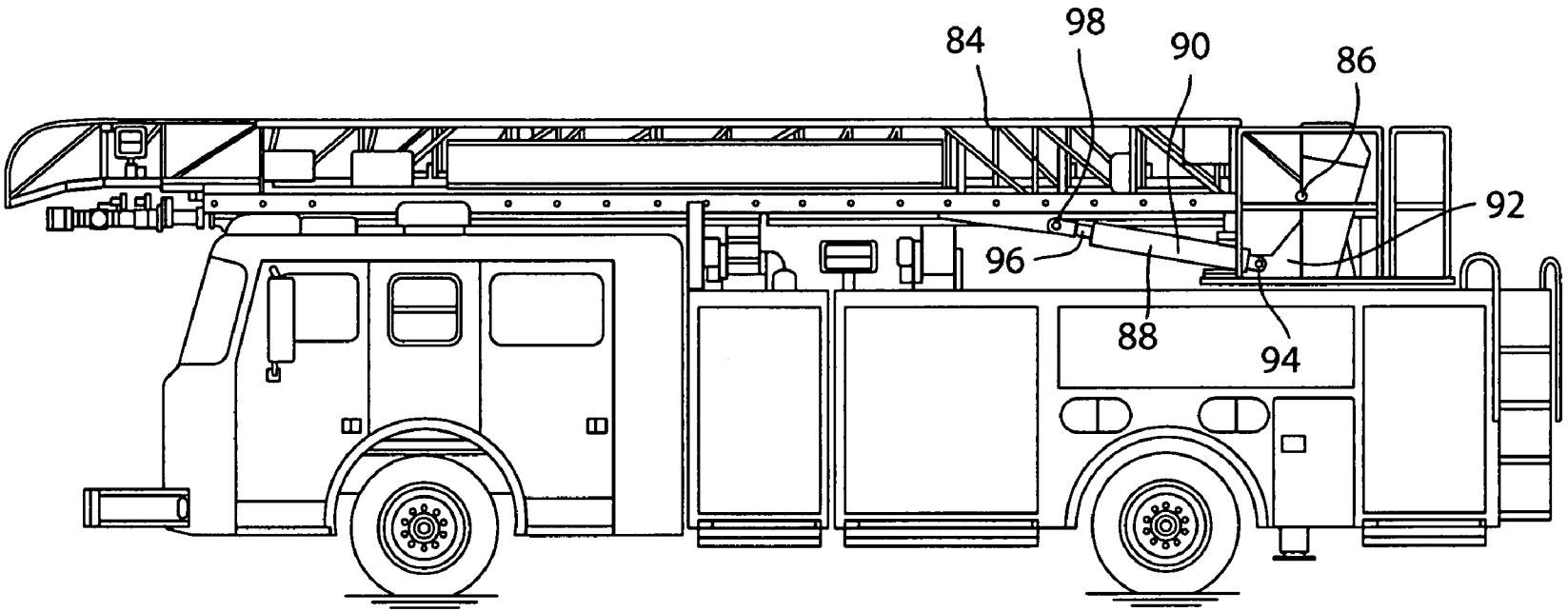
FIG. 5 is a side view of a prior art aerial ladder mount.
Figure 6:
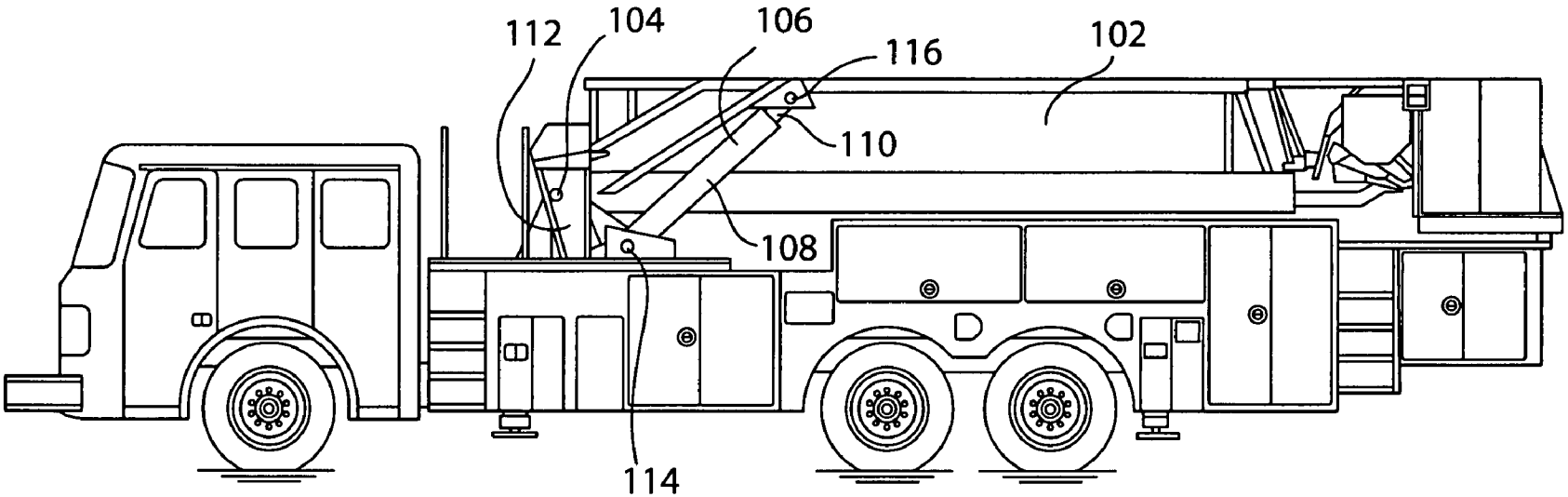
FIG. 6 is a side view of an additional prior art aerial ladder mount.

Referring now to the figures, FIGS. 5 and 6 illustrate two prior art aerial ladder mounts. In FIG. 5, an aerial ladder 84 is pivotally mounted at pivot point 86. The ladder is raised using a cylinder 88 using a two-directional hydraulic system well known in the art. Movement of all cylinders is fluid actuated using a cylinder body and a cylinder rod. For example, shown in FIG. 5 is cylinder 88 having a cylinder body 90 mounted to a ladder superstructure 92 by cylinder mount 94. Cylinder rod 96 is mounted to ladder 84 by a cylinder rod mount 98.

As the rod of cylinder 88 extends, ladder 88 is pivoted upward from pivot point 86. As shown this leverage angle is 15 degrees and therefore limits the payload of the ladder. The point of location of cylinder rod mount 98, cylinder 94, and pivot point 86 form a triangle. Further, it is only possible to lower the ladder slightly below a horizontal position due to the stroke of cylinder.

It is known in the art that the flatter/smaller the triangle the less of a lifting force may be applied. In FIG. 5, the triangle is formed from pivot point 86, cylinder rod mount 98, and cylinder mount 94. It is thus desirable to make the triangle taller/bigger. Unfortunately, the taller/bigger the triangle the higher the profile of the mount. Any aerial ladder application is still attached to a vehicle which must, as a whole, fit under various bridges and other barriers that result in height restrictions. As will be discussed below, the present invention adds improved lifting geometry and therefore more force over the prior art while maintaining a low profile.

FIG. 6 shows another example of a prior art aerial ladder mount employing a taller/bigger triangle. Here, an aerial ladder 102 is pivotally mounted at pivot point 104. Ladder 102 is raised using a cylinder 106 using a two-directional hydraulic system well known in the art. Movement of all cylinders is fluid actuated using a cylinder body and a cylinder rod. For example, shown in FIG. 6 is cylinder 106 having a cylinder body 108 mounted to a ladder superstructure 112 by cylinder mount 114. Cylinder rod 110 is mounted to ladder 102 by a cylinder rod mount 116.

As cylinder rod 110 of cylinder 106 extends, ladder 88 is pivoted upward from pivot point 104. In FIG. 6, the triangle is formed by pivot point 104, cylinder mount 114, and cylinder rod mount 116. As shown, this leverage angle is steep (i.e., a taller/bigger) and therefore increases the mechanical advantage to lift the ladder. Unfortunately, this design also limits operator visibility due to the increased superstructure needed for this design. Further, this type of configuration adds an inward torque (or bending force) on the handrail, which decreases clearance within the ladder The present invention has the advantages of a shorter/smaller triangle (i.e., a low profile), and the advantages of a taller/bigger triangle (i.e., an increased mechanical advantage), while eliminating all the disadvantages (i.e., low mechanical advantage, low visibility, and no handrail bending force).

Figure 1:
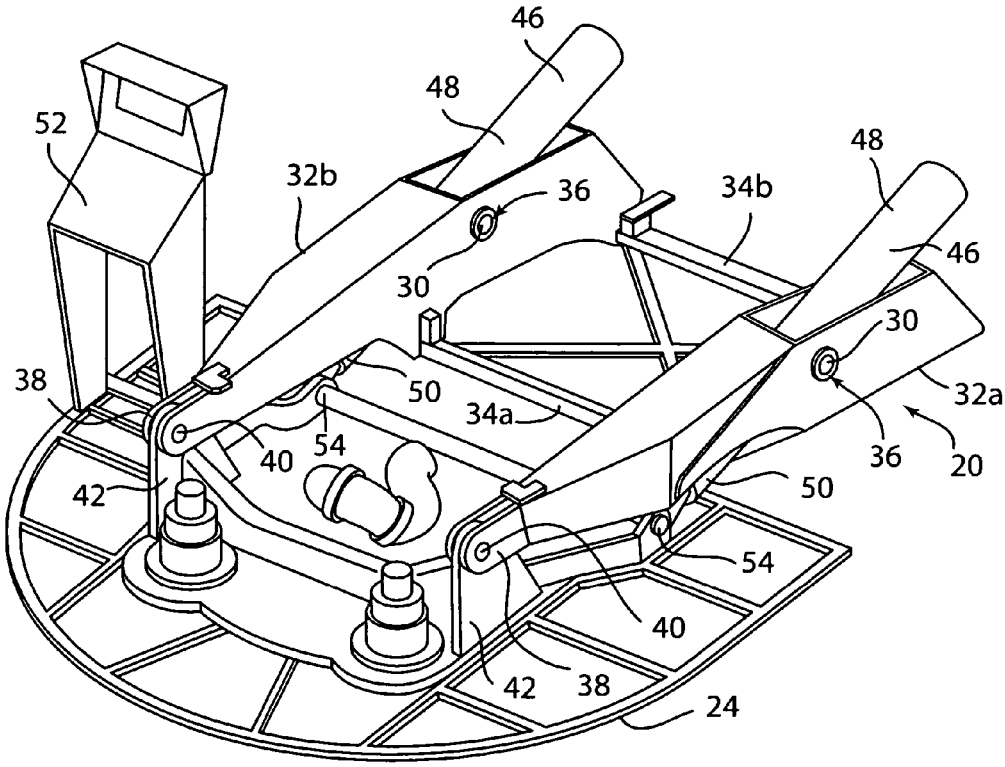
FIG. 1 is a perspective view of a cradle of an embodiment of the present invention mounted on a turntable for an aerial ladder.
Figure 2:
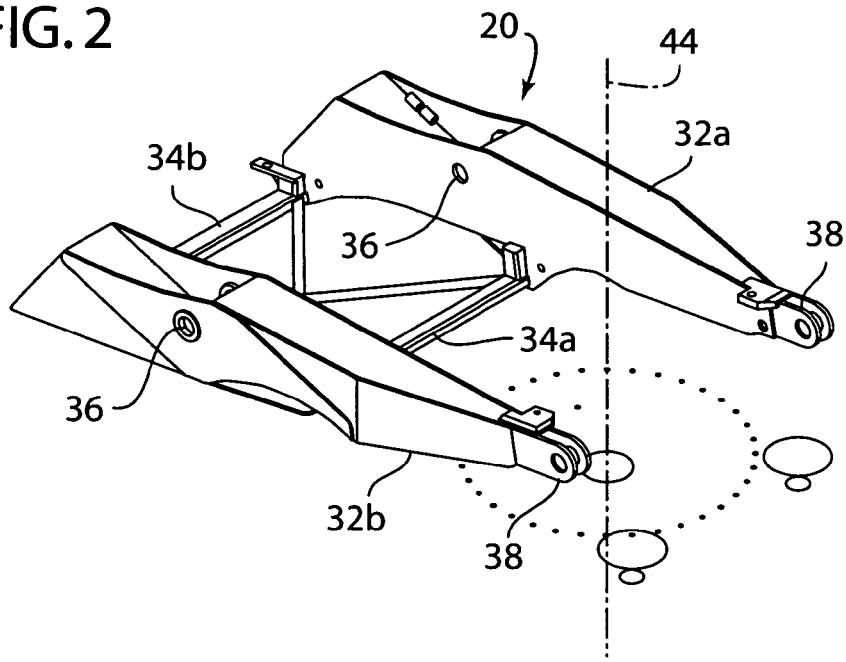
FIG. 2 is a perspective view of the cradle.
Figure 3:
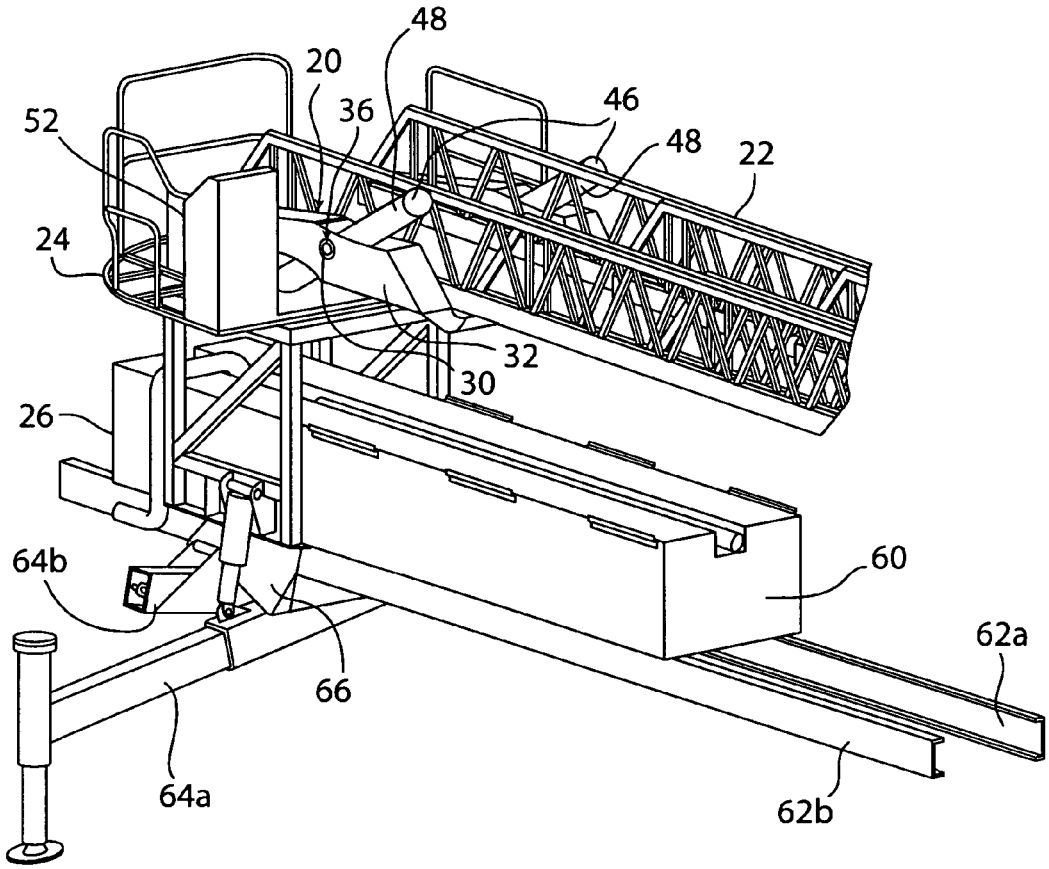
FIG. 3 is a perspective view of an embodiment of the present invention with an aerial ladder mounted thereon.
Figure 4:
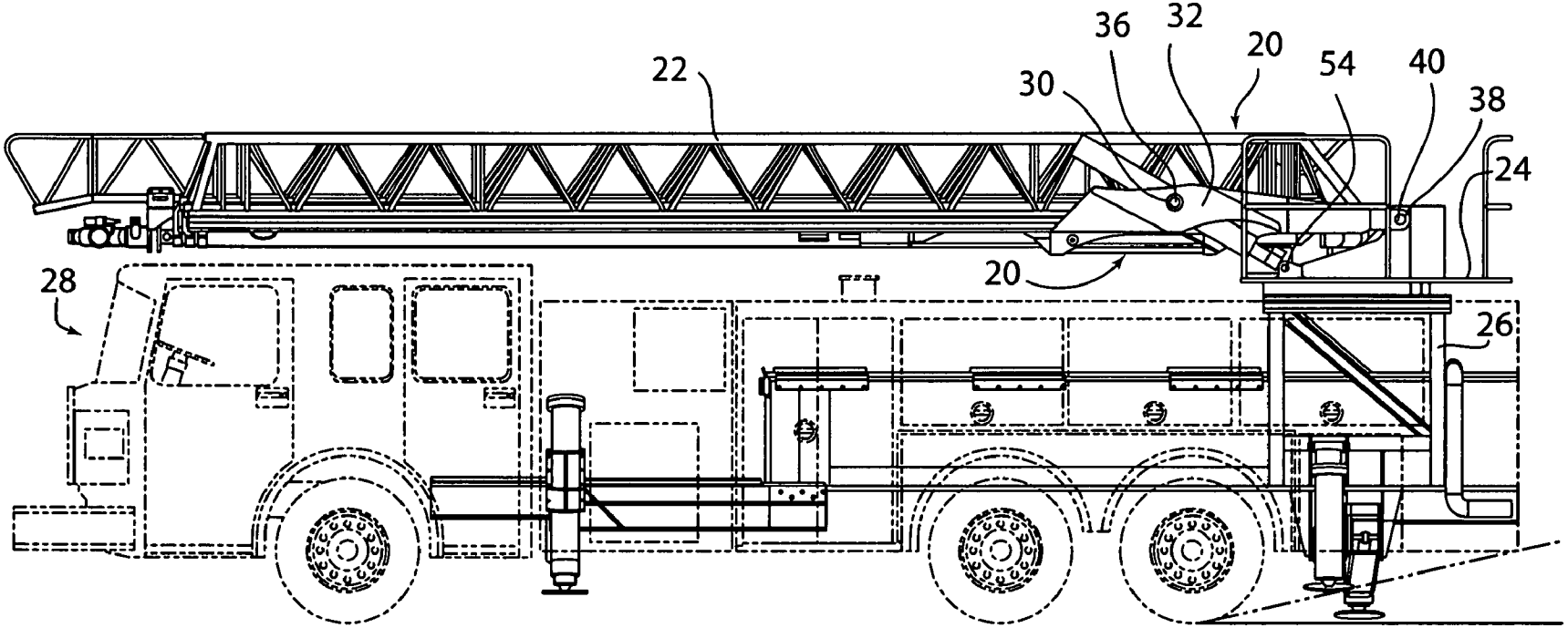
FIG. 4 is a side view of an embodiment of the present invention installed on a fire truck.

In one embodiment of the present invention, as illustrated in FIGS. 1, 2, 3 and 4, a cradle assembly is used, generally indicated at 20. Here, lift is applied to cradle 20, and a ladder 22 is mounted on cradle 20. As illustrated, the side trusses of ladder 20 do not absorb the force of the lifting mechanism, thus eliminating the need to increase the strength of the ladder as demonstrated in FIG. 6 to reduce the bending force on the handrails. FIG. 2 shows cradle 20 uninstalled. FIG. 1 shows cradle 20 installed on an aerial ladder turntable 24. FIG. 3 shows cradle 20 assembled on an aerial ladder chassis. FIG. 4 shows cradle 20 as part of an aerial ladder fire truck 28.

As shown in FIG. 2, cradle 20 has a pair of cradle arms 32*a* and 32*b*. Cradle arms 32*a* and 32*b* are connected by cradle cross members 34*a* and 34*b*. Cradle 20 has connecting points including pivot pin connecting point 38, and trunnion pin connecting point 36. Cradle arms 32*a* and 32*b* are bifurcated at the point at which said trunnion pins 30 are attached, said cylinders 48 being fitted between said bifurcations, each of which have an aperture through which one of said trunnion pins 30 extend.

As shown in FIG. 1, cradle 20 is mounted on turntable 24. Turntable 24 is known in the art and allows rotational movement of aerial ladder 22 about a vertical axis 44. Here, turntable 24 has a ladder control station 52. As shown in FIG. 1, cradle 20 is mounted to turntable 24 at pivot pin connecting point 38 through the use of pivot pins 40 pivotally connected to pivot pin mounting flanges 42 on turntable 24. Ladder 22 is mounted between cradle arms 32*a* and 32*b* and on top of cradle cross members 34*a* and 34*b* using means known in the art such as bolting and welding.

Cradle 20 is also mounted to a cylinder 46 of a two-directional (i.e., double-acting) hydraulic system well known in the art. Movement of all cylinders is fluid actuated using a cylinder body and a cylinder rod. For example, shown in FIGS. 2, 3, and 4, cylinder 46 has a cylinder body 48 pivotally mounted to cradle 20 using trunnion pins 30. A cylinder rod 50 is mounted to turntable 24 by a cylinder rod mounting flange 54.

Figure 2A:
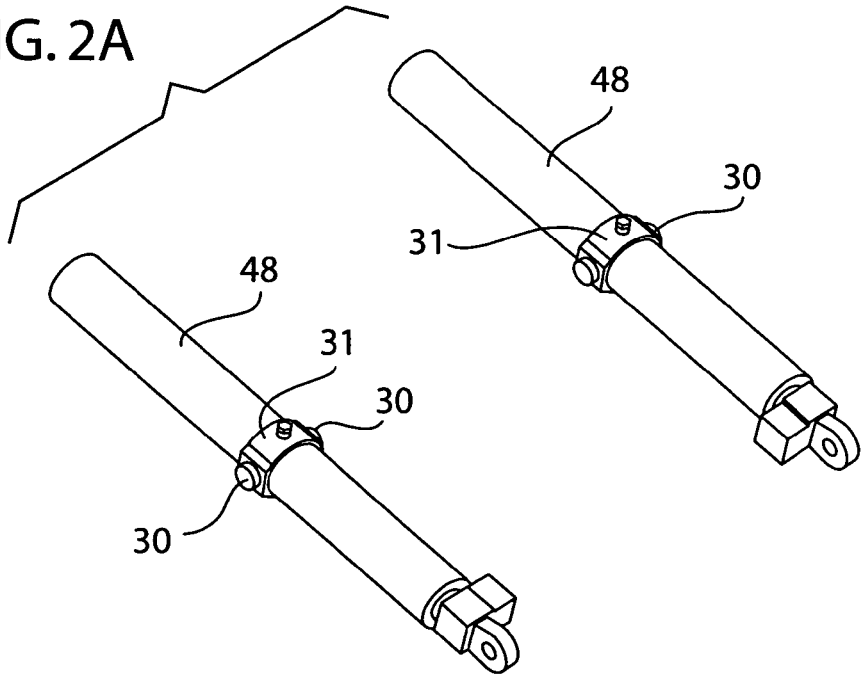
FIG. 2A is a fragmentary perspective view showing trunnion pins affixed to a cylinder casing.

Referring to FIG. 2A, there is seen a preferred arrangement wherein trunnion pins 30 are affixed to opposite sides of a hoop 31 which, in turn, is attached to the exterior of cylinder body 48 using means known in the art such as welding. Note that hoop 31 as illustrated is positioned near the middle of cylinder body 48 although it could even be lower to be near the end through which rod 50 exits.

FIG. 3 shows cradle 20 of the present invention mounted to an aerial ladder chassis 26. Aerial ladder chassis 26 has a torque box 60, chassis rails 62*a* and 62*b*, outriggers 64*a* and 64*b*, and chassis superstructure 66.

In use, as cylinder rod 50 of cylinder 46 extends, cradle 20 is pivoted upward about a pivot axis formed by the two pivot pin connecting points 38. As best shown in FIG. 4, the lifting triangle is formed by a pivot axis formed by the two pivot pin connecting points 38, cylinder rod mount 54, and trunnion pin connecting point 36. As shown, this leverage angle is steep (i.e., taller/bigger) like the example in FIG. 6 while maintaining a low profile as in the example in FIG. 5. Note in FIG. 4 that mounting flanges 54 extend to a substantially lesser elevation above the base of turntable 24 than flanges 42 which support pivot pins 38. Thus, because rod 50 is not fully retracted when ladder 22 is in the horizontal position shown in FIG. 4, further retraction of rod 50 enables lowering of ladder 22 approximately 10 degrees below horizontal.

Unlike the FIG. 6 example, the present invention does not reduce the visibility for the operator and does not require overbuilding the ladder to reduce the effects of inward torque on ladder handrails. Thus, the present invention increases the mechanical advantage to lift ladder 22 over that supplied by the prior art. Also note that the present invention, in contrast to the prior art, extends cylinder rods 50 downwardly and mounts to an axis passing through the cylinder body 48 through the use of trunnion pins 30. As noted above, pins 30 are attached to a hoop 31 which encircles and is welded to the surface of cylinder body 48.

Additionally, the mechanical advantage can be achieved by the turntable structure which has a lower height. This allows for more compartmentalization on the fire truck body for a given overall travel height. This provides for additional storage of emergency equipment. While the invention has special applicability to aerial ladders, it can be used to support other equipment, as well, for example, booms mounted on construction or excavation work vehicles, as will be appreciated by those skilled in the art.

While the invention has been described in conjunction with specific embodiments, it is evident that many alternatives, modifications and variations will be apparent to those skilled in the art in light of the foregoing description. Accordingly, the present invention attempts to embrace all such alternatives, modifications and variations that fall within the spirit and scope of the appended claims.

The invention claimed is:

1. An assembly for rotatably and pivotally supporting an aerial ladder or boom, comprising:

a turntable adapted to be mounted on a vehicle for rotation about a vertical axis;

a first pair of upwardly extending parallel support flanges and a second pair of upwardly extending parallel support flanges extending upwardly from the surface of said turntable, the second pair of flanges extending to a substantially lesser elevation than said first pair of flanges;

a cradle formed by a pair of parallel cradle arms laterally spaced and adapted to support a base end of said ladder or boom therebetween and at least one cross member connecting said arms, each of said arms having an end pivotally connected to a flange of said first pair of flanges; and a hydraulic cylinder having its body pivotally attached to each of said cradle arms at a point spaced away from said first pair of flanges and from said second pair of flanges, an extendable-retractable rod projecting each hydraulic cylinder, each of said rods having an outer end pivotally attached to a flange of said second pair of flanges wherein said cradle arms are bifurcated at the point spaced away from said first pair of flanges, said cylinders being fitted between said bifurcations.

2. An assembly according to claim 1, wherein said cylinders are connected to said arms by means of aligned trunnion pins projecting outwardly from opposite sides of said cylinders.

3. An assembly according to claim 1, wherein said cylinder rods are not fully retracted into said cylinders when said ladder or boom is in the horizontal position whereby an outer end of said ladder or boom can be lowered below the horizontal position.

4. An assembly according to claim 2, wherein said trunnion pins are attached to the exterior of a hoop which encircles and is welded to the body of said hydraulic cylinder.

5. An assembly according to claim 4, wherein said trunnion pins are positioned adjacent the end of said cylinder through which said rod extends.

6. An assembly according to claim 1, wherein said hydraulic cylinders are double acting cylinders.

7. An assembly for rotatably and pivotally supporting an aerial ladder or boom, comprising:

a turntable adapted to be mounted on a vehicle for rotation about a vertical axis;

a first pair of upwardly extending parallel support flanges and a second pair of upwardly extending parallel support flanges extending upwardly from the surface of said turntable, the second pair of flanges extending to a substantially lesser elevation than said first pair of flanges;

a cradle formed by a pair of parallel cradle arms laterally spaced to support a base end of said ladder or boom there between and at least one cross member connecting said arms, each of said arms having an end pivotally connected to a flange of said first pair of flanges;

a hydraulic cylinder pivotally attached by trunnion pins to each of said cradle arms at a point spaced away from said first pair of flanges; and an extendable-retractable rod protecting from each hydraulic cylinder said rod having an outer end pivotally attached to a flange of said second pair of flanges, wherein said cradle arms are bifurcated at the point at which said trunnion pins are attached, said cylinders being fitted between said bifurcations, each of which has an aperture through which one of said trunnion pins extends.

* * * * *